US005148952A

United States Patent [19]

Candat

[11] Patent Number: 5,148,952

[45] Date of Patent: Sep. 22, 1992

[54] VALVE FOR AN AEROSOL CAN HAVING A SEATED VALVE THAT REMAINS CLOSED DURING AN UNDERPRESSURE CONDITION OF THE CAN

[75] Inventor: Pierre Candat, Moussy-le-Vieux, France

[73] Assignee: L'Oreal, Paris, France

[21] Appl. No.: 712,520

[22] Filed: Jun. 10, 1991

[30] Foreign Application Priority Data

Jun. 27, 1990 [FR] France ..... 90 08082

[51] Int. Cl.[5] ..... B65D 83/06

[52] U.S. Cl. ..... 222/402.22; 222/396

[58] Field of Search ..... 222/394, 396, 402.1, 222/402.21, 402.22, 402.23; 137/541, 542; 251/353, 354

[56] References Cited

U.S. PATENT DOCUMENTS 3,018,928 1/1962 Meshberg ..... 222/335
3,520,450 7/1970 Prussin et al. ..... 222/402.22 X
4,061,251 12/1977 Harris ..... 222/402.2
4,341,330 7/1982 Mascia et al. ..... 222/402.1 X
4,669,639 6/1987 Klarenbach et al. ..... 222/402.22

FOREIGN PATENT DOCUMENTS 2375111 7/1978 France .

*Primary Examiner*—Andres Kashnikow
*Assistant Examiner*—Kenneth DeRosa

[57] ABSTRACT

A valve has a body fixed to an aerosol can which projects towards the interior of the can. An actuating rod is provided accessible from the exterior of the can, and adapted to be displaced by the action of a user in order to open the valve. The valve is combined with a seated valve adapted to be located in the interior of the can. The seat valve has a moveable closure element subjected to the action of a calibrated spring in such a manner that when the pressure in the can falls below a predetermined limit, the seated valve remains closed and prevents spraying even if the valve rod is actuated. The seated valve only opens for a pressure in the interior of the container at least equal to the above mentioned predetermined limit.

9 Claims, 2 Drawing Sheets

VALVE FOR AN AEROSOL CAN HAVING A SEATED VALVE THAT REMAINS CLOSED DURING AN UNDERPRESSURE CONDITION OF THE CAN

BACKGROUND OF THE INVENTION

The invention relates to a valve for an aerosol can. The valve is of the type for spraying a product contained under gas pressure in the can and has a body fixed to the can and projecting towards the interior of this can. An actuating rod is accessible from the exterior of the can and adapted to be displaced by the action of the user in order to open the valve.

When spraying a product, especially hair lacquer, it is desirable to obtain high quality spraying over the entire period of use of the can, i.e. a suitable flow rate and size of the atomised droplets. This problem arises in particular when the gas pressure in the interior of the can is ensured by means of a compressed gas ($N_2$, $CO_2$ or air), because the pressure gradually decreases during repeated use.

SUMMARY OF THE INVENTION

The object of the invention is above all to provide a valve which solves the above mentioned problem by automatically preventing spraying when the pressure in the interior of the can falls below a predetermined pressure, regarded as the minimum to ensure suitable spraying. In the case of a can that can be refilled with a compressed propellant, the user will be alerted in this manner that the can has to be refilled with compressed gas.

Another object of the invention is to provide a valve of this kind which has a simple and economical design and which can be produced in a simple manner starting from conventional valves that do not automatically prevent spraying from a certain minimum pressure.

According to the invention, a valve for an aerosol can of the type defined hereinbefore is characterised in that it is combined with a seated valve adapted to be located in the interior of the can, and comprising a movable closure element subjected to the action of a calibrated spring in such a manner that when the pressure in the can falls below a predetermined limit, the seated valve remains closed and prevents spraying even if the valve rod is actuated. The seated valve only open for a pressure in the interior of the container at least equal to the abovementioned predetermined limit.

The movable closure element of the seated valve advantageously consists of a ball. As a variant, this movable element may consist of a needle or some other equivalent means.

The seated valve preferably comprises a tubular casing fixed to the valve body so as to cover the entrance to this body. The casing comprising an orifice for communication with the interior of the can, and this orifice comprising a seating for the movable closure element. The calibrated spring tends to bring the closure element against this seating.

The valve according to the invention advantageously comprises a standard conventional valve, and the casing of the seated valve is added and fixed to the body of this conventional valve.

The casing of the seated valve is generally provided with a connector coaxial with the communication orifice for branching a dip tube.

An additional gas inlet, opening transversely, may be provided in the casing of the seated valve above the seating of the ball at the interior of the can.

When the valve is produced from a standard valve, the body of which comprises an extension for connection to a dip tube, the casing of the seated valve also covers this extension and the calibrated spring is disposed coaxially around this extension so as to rest against the end of the body of the standard valve.

The predetermined pressure from which the seated valve opens is preferably approximately 2 bar.

The invention also relates to an aerosol can provided with a valve such as the one defined hereinbefore.

BRIEF DESCRIPTION OF THE DRAWINGS

In addition to the arrangements described hereinabove, the invention consists of a number of other features which will be described in more detail hereinafter with reference to one embodiment described by way of a non-limiting example and illustrated in the accompanying drawings, in which.

DETAILED DESCRIPTION OF THE PREFERRED EMBODIMENTS

Figure 1:
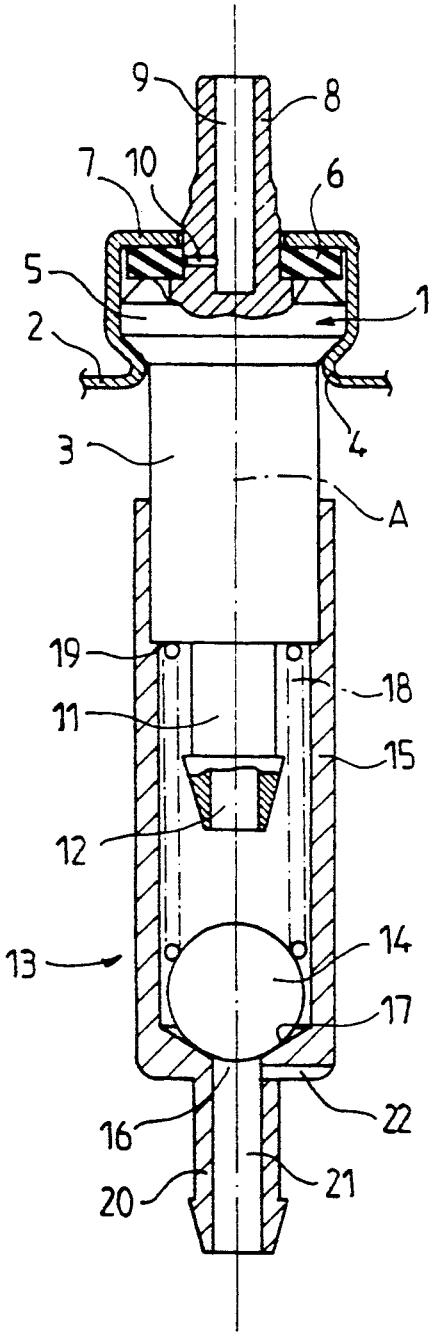
FIG. 1 is an axial section, with exterior parts, of a valve according to the invention, the actuating rod being in the closed position.

Referring to FIG. 1, it shows a valve 1 for an aerosol can (not shown) containing a liquid product under gas pressure.

The valve 1 comprises a body 3 fixed to the can by means of crimping 4 adapted to confine in a cup 2 provided on the can a portion 5 of larger diameter provided at the upper end of the body 3.

This portion 5 rests against a sealing washer 6 which itself rests against a collar 7 of the cup 2, the median plane of which is orthogonal to the axis of the can.

The cylindrical body 3 projects towards the interior of the can and comprises a conventional valve mechanism (not shown). An actuating rod 8 for the valve is slidably mounted in the body 3 in the axial direction A. The rod 8 comprises a longitudinal blind hole 9 opening towards the top and into which there opens, in the vicinity of the base, a radial channel 10 communicating with the outer surface of the rod 8.

The rod 8 is returned to the rest position illustrated in FIG. 1 by elastic means (not shown). In this position, the channel 10 is situated substantially half way along the thickness of the washer 6 and is closed by the inner cylindrical wall of this washer.

The body 3 is that of a standard valve and comprises an extension 11 of smaller diameter provided with an inlet channel 12. The extension 11 is provided for a connection to a dip tube (not shown) extending towards the base of the can.

Figure 2:
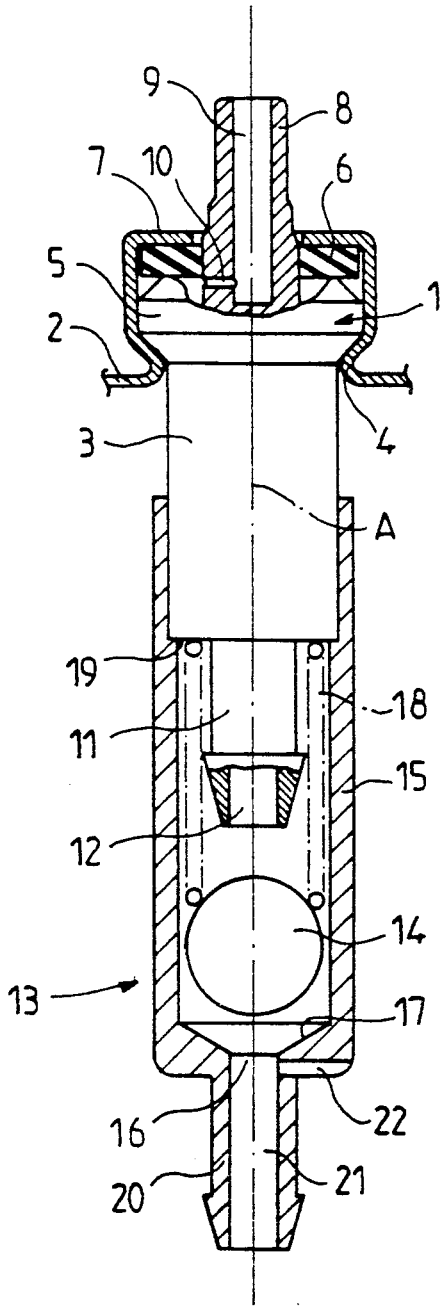
FIG. 2 shows, like FIG. 1, the valve when the rod is in the open position, the pressure in the can being greater than the predetermined limit, and, finally.

The insertion of the rod 8 into the body 3 is generally controlled by acting on a push-button (not shown), so that the channel 10, as illustrated in FIG. 2, opens into a volume situated below the sealing washer 6.

A seated valve 13 having a movable closure element consisting of a ball 14 is provided in the interior of the can and is combined with the standard valve. The movable closure element of the seated valve could of course consist of a needle, or some other equivalent means. The seated valve 13 comprises a casing 15 fixed to the body 3 so as to cover the extension 11 and to cover the entrance 12.

The casing 15 comprises an orifice 16 for communication with the interior of the can. This orifice 16 has a truncated seating 17 for the ball 14. This ball is subjected to the action of a calibrated spring 18. In the example illustrated in the drawings, the spring 18 is a helical spring disposed coaxially around the extension 11 so that it rests against the end 19 of the valve body 3. The spring 18 tends to bring the ball 14 against the seating 17, thereby closing the orifice 16.

It is clear that the expression "calibrated spring" must be understood in the wider sense and includes any calibrated elastic means acting like a spring, inter alia, a leaf spring.

The casing 15 of the seated valve is provided with a fitting 20 coaxial with the orifice 16 for branching a dip tube (not shown). The fitting 20 comprises a channel 21 into which there opens an additional gas inlet 22 formed by a radial passage provided at the side of the orifice 16 opposite the ball 14. The additional gas inlet 22 brings the channel 21 into communication with the interior volume of the can.

The spring 18 is advantageously calibrated so as to hold the seated valve 14 against the seating 17 until the difference in pressure between the interior of the can and the inner chamber of the casing 15 is less than a value of approximately 2 bar.

This being the case, the valve according to the invention operates as follows.

At rest, as illustrated in FIG. 1, the rod 8 is in the closed position and the ball 14 rests against the seating 17 under the action of the spring 18. The pressures in the interior of the can and the casing 15 are substantially the same.

When the user actuates the valve and depresses the rod 8, as illustrated in FIG. 2, the interior of the casing 15 is brought into communication with the atmosphere via the channel 10 and the pressure in this casing 15 falls below the gas pressure prevailing in the can. When this gas pressure is sufficient, it exerts a force on the ball 14 greater than that of the spring 18 and therefore moves the ball 14 away from its seating 17 as illustrated in FIG. 2.

The product to be sprayed can then pass through the channels 21, the orifice 16, the entrance 12, the channel 10 and the hole 9, in order to emerge into the atmosphere from the nozzle of a distributor head (not shown) in the form of atomised droplets.

Figure 3:
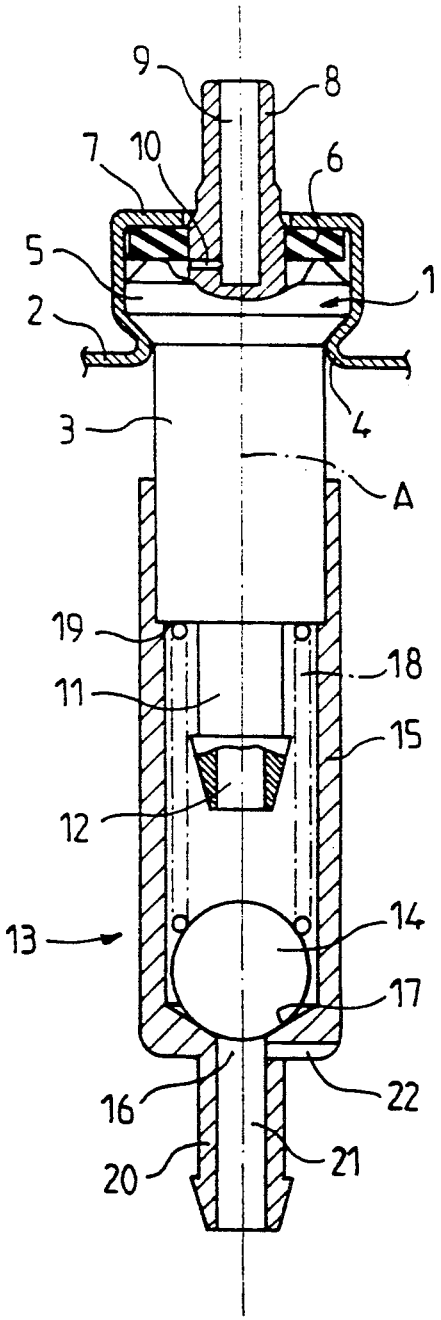
FIG. 3 shows the valve, like FIG. 2, when the pressure in the can is lower than the predetermined limit.

If the pressure in the can is lower than the limit set by the spring 18, the ball 14 remains against the seating 17 in spite of the depression of the rod 8, as illustrated in FIG. 3.

Under these conditions, even if the user depresses the rod 8, there will be no spraying. This prevents spraying when the pressure conditions are insufficient, leading to poor quality spraying.

Therefore, by virtue of the valve according to the invention, it is possible to ensure correct dispensing of the product. When the pressure in the can becomes too low, dispensing will only be resumed once this pressure has risen again to a sufficiently high value to cause unlocking of the ball 14. This rise in pressure may be obtained, in the case of refillable cans, by an operation consisting of refilling with propellant.

This valve has a simple and economical design and may be obtained by rapid modification of a standard conventional valve.

I claim:

1. A valve for spraying a product contained under pressure in an aerosol can, the valve comprising:

a first valve means for spraying the product in response to actuation of an actuating rod by a user, the first valve means having a body coupled to the aerosol can which extends towards the interior of the aerosol can, the body having at one end an extended portion for being connected to a dip tube; and a seated valve means, in the interior of the aerosol can, coupled to the body for preventing the spraying of the product by the first valve means, even if the actuation rod is actuated, when a pressure in the interior of the aerosol can is less than a predetermined limit, the seated valve means including, a casing for covering the extended portion and being coupled to the body, a moveable closure element preventing or permitting supply of the product for spraying by the first valve means, and a calibrated spring disposed coaxial with the extended portion, a first end of the calibrated spring resting against the one end of the body and a second end of the calibrated spring exerting a force against the moveable closure element, the force exerted on the moveable closure element being such that the moveable closure element prevents supply of the product, even if the actuating rod is actuated, when the pressure in the interior of the aerosol can is less than the predetermined limit and permits supply of the product when the pressure in the interior of the aerosol can is greater than or equal to the predetermined limit.

2. Valve according to claim 1, wherein the movable closure element of the seated valve is a ball.

3. A valve according to claim 1, wherein the casing is tubular and has an orifice for communicating with the interior of the aerosol can, the orifice has a seating for the moveable closure element, and the calibrated spring brings the moveable closure element against the seating to cover the orifice.

4. Valve according to claim 3, further comprising a gas inlet provided in the casing below the seating.

5. Valve according to claim 3, wherein the casing is provided with a connector coaxial with the orifice for branching a dip tube.

6. Valve according to claim 1, wherein the predetermined limit is approximately 2 bar.

7. Aerosol can provided with a valve according to claim 1.

8. A valve device having a first valve means for spraying a product contained in an aerosol container in response to actuation of an actuating rod by a user, the first valve means having a body coupled to the aerosol container which extends towards the interior of the aerosol container, the body having at one end an extended portion for being connected to a dip tube for spraying a product contained under pressure in an aerosol container, the valve comprising:

a seated valve, in the interior of the aerosol container, coupled to the body for preventing the spraying of the product by the first valve means, even if the actuation rod is actuated, when the pressure in the interior of the aerosol container is less than a predetermined limit, the seated valve including.

a casing for covering the extended portion and being coupled to the body, a moveable closure element controlling supply of the product for spraying by the first valve means, and a calibrated spring disposed coaxial with the extended portion, a first end of the calibrated spring resting against the one end of the body and a second end of the calibrated spring exerting a force against the moveable closure element, the force exerted on the moveable closure element being such that the moveable closure element prevents supply of the product, even if the actuating rod is actuated, when the pressure in the interior of the aerosol container is less than the predetermined limit and permits supply of the product when the pressure in the interior of the aerosol container is greater than or equal to the predetermined limit.

9. An aerosol can having a valve for spraying a product contained under pressure in the aerosol can, comprising:

an aerosol can body for containing a product under pressure;

a first valve means for spraying the product in response to actuation of an actuating rod by a user, the first valve means having a valve body coupled to the aerosol can body which extends towards the interior of the aerosol can body, the valve body having at one end an extended portion for being connected to a dip tube; and a seated valve means, in the interior of the aerosol can body, coupled to the valve body for preventing the spraying of the product by the first valve means, even if the actuation rod is actuated, when a pressure in the interior of the aerosol can body is less than a predetermined limit, the seated valve means including, a casing for covering the extended portion and being coupled to the valve body, a moveable closure element controlling supply of the product for spraying by the first valve means, and a calibrated spring disposed coaxial with the extended portion, a first end of the calibrated spring resting against the one end of the valve body and a second end of the calibrated spring exerting a force against the moveable closure element, the force exerted on the moveable closure element being such that the moveable closure element prevents supply of the product, even if the actuating rod is actuated, when the pressure in the interior of the aerosol can body is less than the predetermined limit and permits supply of the product when the pressure in the interior of the aerosol can body is greater than or equal to the predetermined limit.

* * * * *